US005558257A

United States Patent [19]

Braun

[11] Patent Number: 5,558,257

[45] Date of Patent: Sep. 24, 1996

[54] OVAL INTEGRAL SLANT PUMP

[75] Inventor: Morris Braun, Chicago, Ill.

[73] Assignee: W. Braun Company, Chicago, Ill.

[21] Appl. No.: 316,845

[22] Filed: Oct. 3, 1994

[51] Int. Cl.[6] ..... B65D 37/00

[52] U.S. Cl. ..... 222/212; 222/215; 222/482

[58] Field of Search ..... 222/153.09, 206, 222/211, 212, 215, 464.1, 481, 482, 567, 633

[56] References Cited

U.S. PATENT DOCUMENTS

| | | | |
|---|---|---|---|
| 2,002,635 | 5/1935 | Kinney | 222/211 |
| 3,398,427 | 8/1968 | John | 222/464.1 X |
| 4,022,351 | 5/1977 | Wright | 222/212 X |
| 4,024,992 | 5/1977 | Schmid | 222/211 |
| 4,645,097 | 2/1987 | Kaufman | 222/211 X |
| 4,898,306 | 2/1990 | Pardes | 222/206 |
| 4,928,859 | 5/1990 | Ecker | 222/211 |

FOREIGN PATENT DOCUMENTS

| | | | |
|---|---|---|---|
| 2038779 | 7/1980 | United Kingdom | 222/211 |

*Primary Examiner*—Joseph A. Kaufman
*Attorney, Agent, or Firm*—Michael G. Berkman

[57] ABSTRACT

A compressible, resilient, manually-energized pump functioning also as a container or reservoir for fluid products to be dispensed. The container is of a unitary construction in which a product discharge conduit is integrally formed with the reservoir with which it communicates, the conduit being joined at an upper extremity thereof to a generally horizontal discharge pipe section terminating in a constricted delivery port. An elongate web integrally formed with the container and the delivery conduit extends between and joins the conduit to the container wall along a height expanse of the container to establish a strong and stable, composite structure.

10 Claims, 2 Drawing Sheets

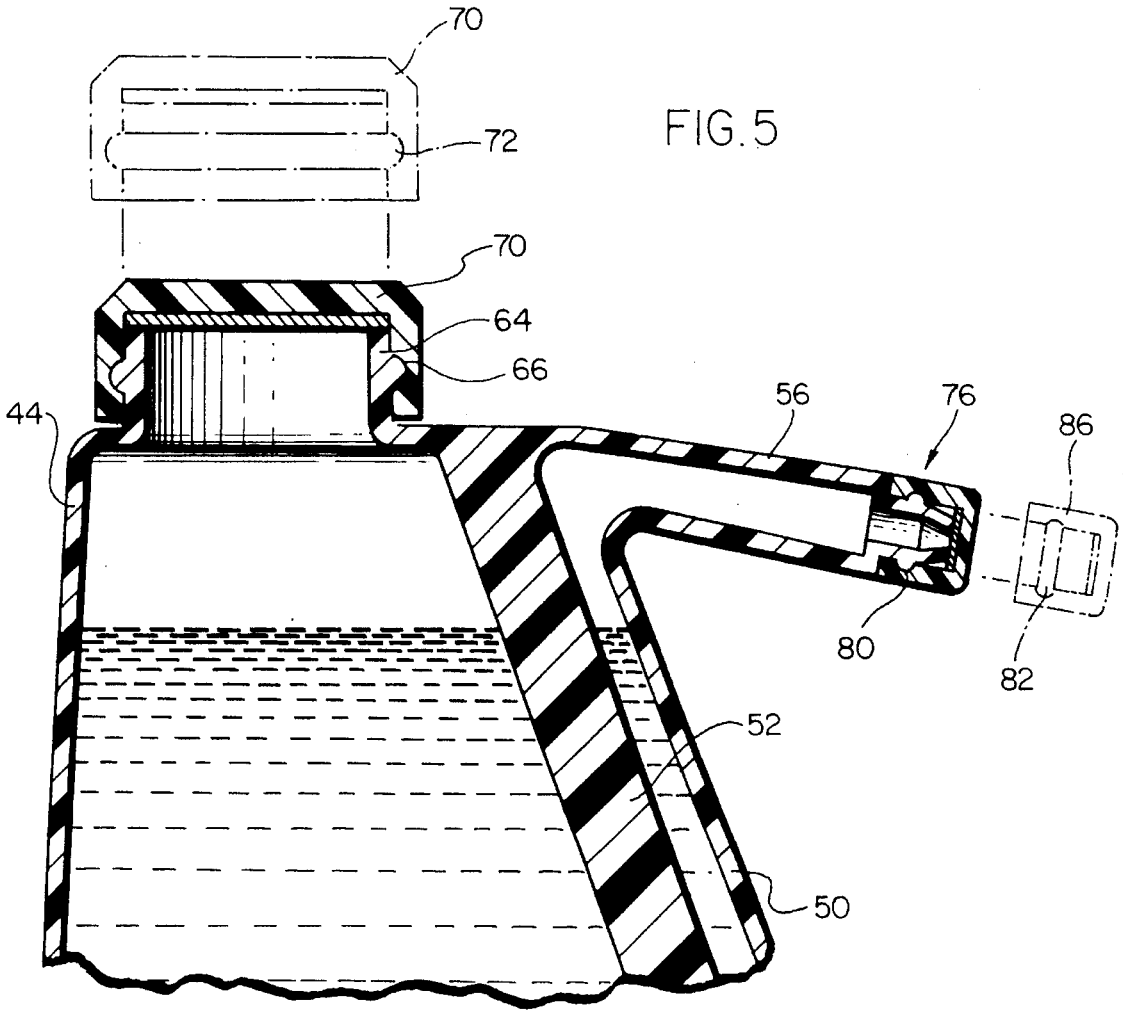
FIG. 5
FIG. 6
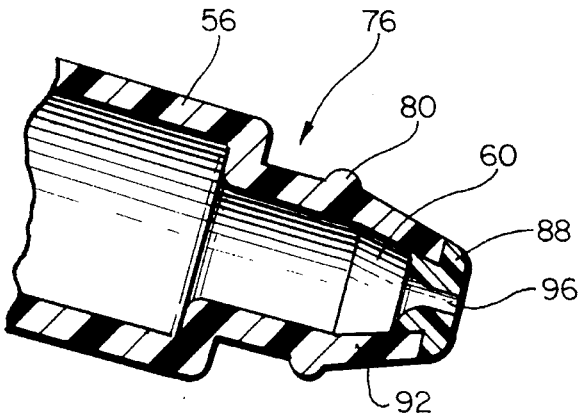

OVAL INTEGRAL SLANT PUMP

FIELD OF THE INVENTION AND BACKGROUND

The present invention relates to a combination storage vessel and delivery pump. More particularly, the invention is directed to a unitary, integrally-formed resiliently-compressible container or reservoir from which a stored fluid product may be readily dispensed through a discharge conduit. Delivery of fluid is conveniently effected by application of compression forces, manually, to the container body itself.

Manually compressible containers combined with fluid dispensing structures are known in the art. Such hand-operated "pumps" have taken many and varied physical forms. Some configurations have proven difficult to grasp and manipulate with one hand. Others are hard to control as to volume of product delivered or dispensed. Still others have been unduly cumbersome, lacking aesthetic appeal. Manufacturing or fabrication problems have contributed to objectionably high production costs for some devices of the general class here involved, It is therefore, a principal aim of the present invention to provide a relatively simple, aesthetically attractive yet operationally superior combination storage container and pump assembly which obviates many of the shortcomings of earlier devices.

SUMMARY OF THE INVENTION

The present invention comprises a storage vessel or container which serves also as a pump for controllably dispensing a fluid product stored in the body or chamber of the container.

It is an important feature of the invention that the assembly is fabricated of a deformable yet resilient plastics composition exhibiting high strength and along useful life.

A related feature is that the container and pump assembly of the invention is fabricated as a unitary, integrally-molded structure which includes a fluid delivery conduit terminating in a delivery spout.

In a preferred embodiment of the invention the fluid delivery conduit is physically supported and mechanically stabilized by physical attachment to the body of the container through a connecting elongated web, the latter extending along substantially the full height expanse of the storage container.

A practical feature of the container of the invention, contributing to ease of operation, is that the bounding walls are contoured to facilitate hand gripping, and operation of the assembly through manual compression forces applied to the container body.

A related feature of the invention is that the bounding, vertically-extending, circumscribing wall of the container tapers upwardly from an enlarged generally ellipsoid base or floor to a reduced, essentially sound annular shoulder structure which supports a threaded neck.

An important physical feature of the assembly is that the fluid-delivery conduit terminates at its upper extremity in an integrally-formed, outwardly-directed spout section. The spout sections also functions as a mechanical hand-engaging rest or stop to prevent the container from slipping from the grasp of the user.

It is a feature of the container and pump assembly of the invention that the fluid-delivery conduit or tube extends at a slant, from a locale at the base of the container and forwardly thereof, and is angled upwardly and rearwardly along a correspondingly angled, paralleling wall of the container, along a height expanse thereof to terminate in an outwardly projecting delivery sector.

A related feature of the invention is that highly efficient and effective utilization of the container through manually-effected pumping operation is achievable simply by tilting the vessel slightly forwardly and downwardly so as to direct any residual stored fluid into the delivery conduit for propulsion therethrough and expulsion therefrom It is a feature of a preferred example of the container pump assembly that it includes, at the end of the fluid delivery conduit, an integrally-formed, restricted, discharge orifice or port, The container of the storage vessel and pump assembly of the invention is closed with a cap threadedly secured to the neck of the container.

In other preferred embodiments of the invention, the closure cap is a snap-on cap.

It is an important feature of the container of the invention that upon cessation of vessel-distorting compression forces applied to said container to distort the container and dispel fluid from the reservoir, the container recovers its original shape. During which recovery, vacuum forces are developed in the container and act effectively to draw ambient air into the orifice opening and through the tubular conduit to, clear from the conduit, compositions which might otherwise harden in and tend to clog the orifice at the end of the composition-dispensing conduit.

A feature of the invention is that it includes adapters in the form of bored plugs and bored caps which may be affixed to the composition delivering end of the tubular conduit for regulating and varying the rate at which fluid is dispensed from the reservoir, as well as the forcefulness of the stream discharged.

The physical shape, contour or configuration of the containers of the invention is not critical. All embodiments of the invention are characterized in that each has the inherent capability of returning to or assuming its original shape after compression forces applied are released.

Other and further features and advantages of the invention will be evident upon review of the following detailed description considered in conjunction with the drawings.

BRIEF DESCRIPTION OF THE DRAWINGS

FIG. 5 is an enlarged fragmentary view of the upper part of the pump of the invention fitted with a snap-on closure for the filling port, and a snap-on cap for closing and protecting the orifice of the delivery spout; and FIG. 6 is an enlarged, fragmentary view of the discharge orifice end of the product delivery spout fitted with a removable orifice-size-reducing plug insert.

DESCRIPTION OF THE ILLUSTRATED EMBODIMENT

The aims and objects of the invention are achieved by providing, in combination, a fluid storage vessel or container and an integrally-formed fluid delivery conduit or tube. The container itself is of a plastics composition and includes flexible and resilient walls which are readily deformable under applied manual pressure. Such applied pressure serves forcibly to urge fluid into and through the conduit, ultimately to be controllably discharged from an orifice or constricted port at an exposed end of the delivery conduit.

An important and functionally significant feature of the container vessel and pump assembly of the invention is that the fluid delivery conduit is supported outside of the vessel by means of a web securing the conduit to the rearwardly sloping wall of the vessel. In the arrangement described, the exit from the vessel to the conduit is at the base of the vessel, at a forward extremity thereof, enabling one readily to expel the "last" of the fluid contents from the container.

In a preferred embodiment of the invention, the assembly 20, exclusive of the cap 42, is fabricated in a blow-molding operation.

Figure 1:
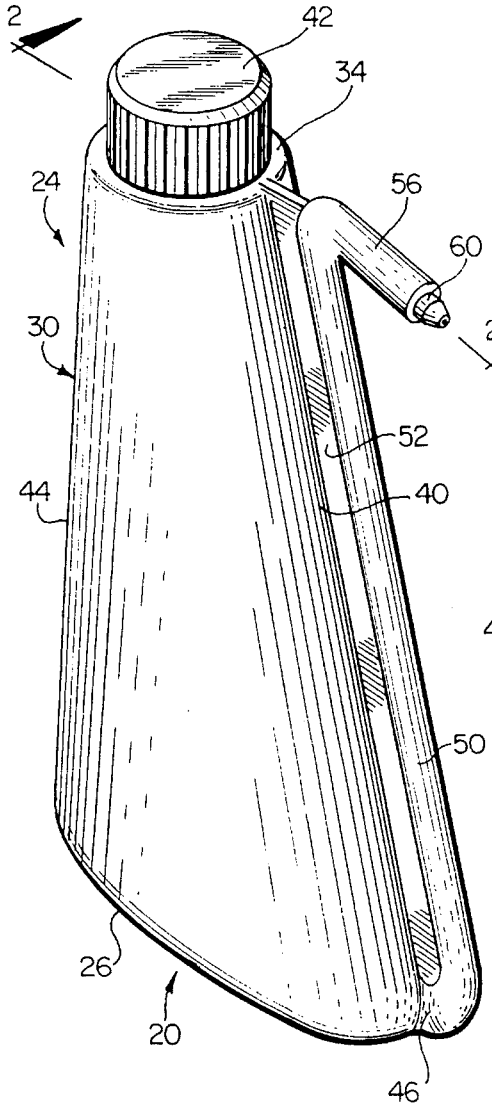
FIG. 1 is a perspective view of a fluid dispensing pump according to the present invention and embodying the features thereof.
Figure 2:
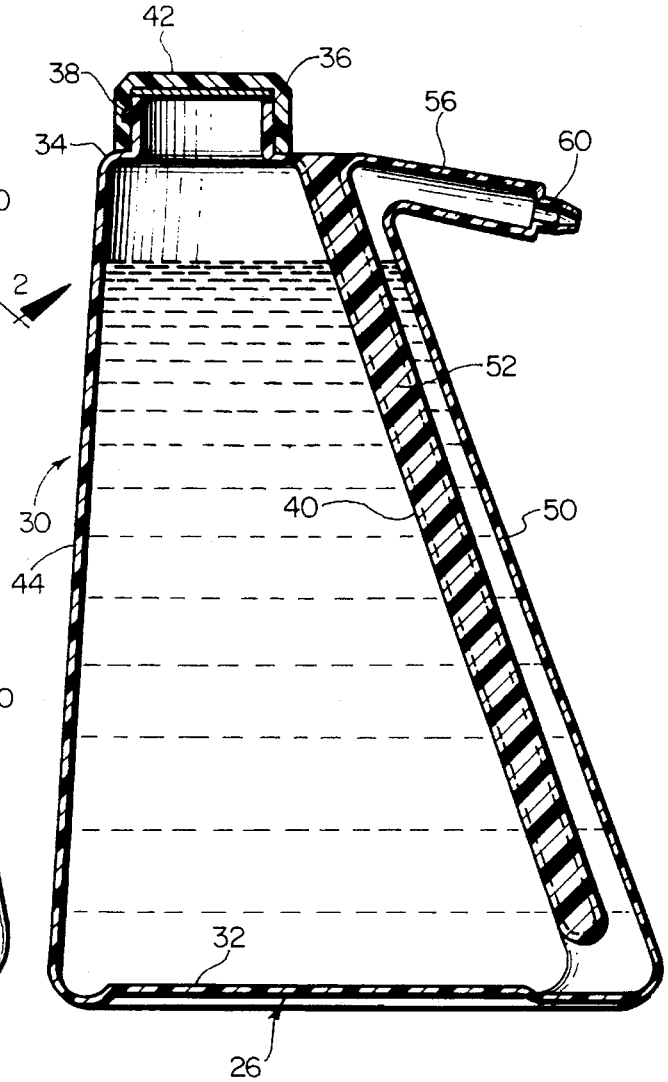
FIG. 2 is a vertical cross-sectional view taken on the lines 2—2 of FIG. 1, and showing the delivery conduit and its supporting web.
Figure 3:
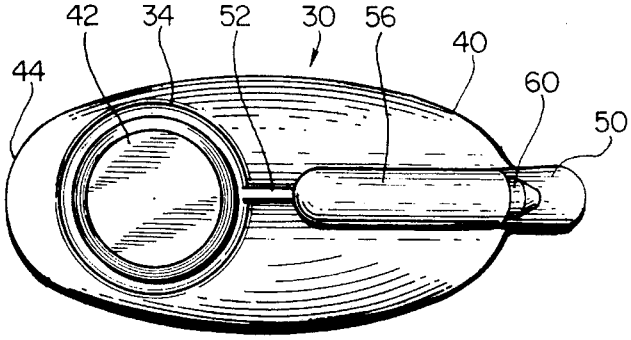
FIG. 3 is a top plan view of the pump showing the generally oval, upwardly tapered body terminating in a surmounting round shoulder, neck, and closure cap.
Figure 4:
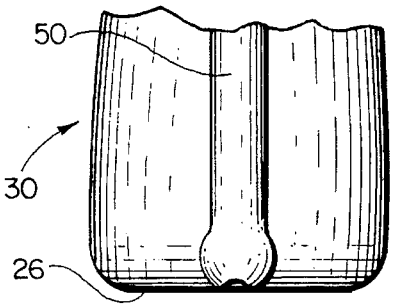
FIG. 4 is a fragmentary view showing the lower fluid input end section of the fluid delivery conduit.

Referring now to the drawings, and more particularly to FIGS. 1 and 2, for purposes of disclosure, and not in any limiting sense, a preferred embodiment of the combination storage vessel and pump assembly 20 of the invention is depicted. As shown, the assembly 20 includes a container or vessel body 24 with a base or floor 26 integrally joined to a circumscribing upwardly and inwardly directed wall 30. A major center zone 32 of the floor 30 is slightly elevated. The circumscribing wall 30 of the container body 24 is surmounted by a radially inwardly directed shelf or shoulder 34. The latter is connected, in turn, to an integrally formed neck 36 having outer threads 38. A cap 42 threaded, interiorly for mating with the threaded neck 36, surmounts the container vessel 24.

In the embodiment of the invention depicted, the base 26 of the container body 24 is generally an elongate ellipsoid in shape. The connected upstanding wall 30 is asymmetrically disposed. That is, the wall 30 has a somewhat greater rearward angle or tilt at a forwardly presented zone 40 as compared with the rearward wall 44 (FIG. 2).

Connected into the container wall 44 at a forward extremity of the floor or base 26, where the wall 40 joins 46, the base 26 is a tube or conduit 50. The latter is spaced from and upwardly along and parallel to the container wall 40. Along its entire vertical expanse the tube 50 is integrally fastened to the container wall 40 by a web 52. At an upper limit the conduit 50 is formed with a forwardly directed spout section 56 angled slightly downwardly. The spout section 56 terminates in a somewhat restricted orifice 60 through which fluid product is dispensed, when the container 24 is compressed manually.

As shown in FIG. 5, in one preferred embodiment of the invention, the neck 64 is formed with an outer annular ring or bead 66 and the cap 70 is formed with a circumscribing inner annular radially inwardly opening groove or chanel 72. The structural arrangement described renders the closure cap 70 a "snap-on" cap.

Referring further to FIG. 5 (and FIG. 6), the nozzle structure 76 at the end of the product delivery spout section 56 is formed with a circumscribing bead-like ridge 80 for seating in a cooperating annular groove 82 formed in a snap-on closure cap 86.

Also, as shown in FIG. 6, the effective diameter of the discharge orifice 60 may be reduced by means of a bored plug 88 which may be inserted into the open end of the discharge spout 92. The plug 88 has a through bore or vent 96 which may have any selectable diameter.

What is claimed is:

1. A manually-compressible, resilient container for storing and for positively dispelling and delivering fluid compositions contained therein, said container comprising a body defining a fluid reservoir, said body including a floor-like base, wall means projecting upwardly of said base and being formed, as an extension thereof, at upper limits of said wall means, with a neck defining a port through which said container is filled, cap-like closure means for sealing said port after introducing a fluid composition into said reservoir, tubular conduit means including dispenser tube means integrally formed with and supported exteriorly of and radially-outwardly of a diametric limit of said container for establishing fluid flow communication with said reservoir at a locale adjacent said base of said container, said conduit means projecting upwardly of said base and extending within limits defined by lower and upper bounds of said body of said container, said conduit means having a terminal discharge end, said base being generally ellipsoid, and said wall means extending upwardly of said base and being smooth and uninterrupted circumferentially, and said base being planar, said wall means being angled generally inwardly of said base, and defining a continuous and smooth annular configuration, a nozzle integrally formed with said dispenser tube means at said terminal discharge end thereof, web means projecting outwardly of and extending along said wall means for connecting said wall means with said tubular conduit means for supporting and for stabilizing said conduit means;

said web means being integrally formed with said wall means and with said conduit means, and extending along an upward reach of said conduit means, and orifice means at said terminal discharge end of said conduit means for delivery of a fluid composition positively dispelled from said reservoir upon application of compression forces to said wall means of said container.

2. A container as set forth in claim 1 and further comprising coupling means integrally formed in said neck about said port for engaging said closure means, and comprising groove means formed in said closure means for receiving in interlocking engagement therewithin said coupling means bounding said port.

3. A container as set forth in claim 1 wherein said closure means comprises snap-on cap means for closing said port.

4. A container as set forth in claim 1 wherein said closure means is a thread cap and wherein said neck is formed closure means.

5. A container as set forth in claim 1 and further comprising threaded closure means for said dispenser tube means and threaded means formed on an end zone of said conduit means for accepting said threaded closure means to seal said dispenser tube.

6. A container as set forth in claim 1 and further comprising orifice-sealing tip means for sealing said orifice means in said dispenser tube means.

7. A container as set forth in claim 1 and further comprising reducing-plug means for seating in said orifice means for selectively varying and setting flow of fluid dispensed from said dispenser tube means.

8. A container as set forth in claim 1 wherein upon cessation of compression forces applied to said container, said container recovers a configuration which corresponds substantially to an original contour of said container.

9. A container as set forth in claim 8 wherein upon cessation of compressing forces applied to said container and during associated recovery of said container to assume its original shape, vacuum forces developed in said container act effectively to draw ambient air into said orifice means and through said tubular conduit means to remove from said conduit means compositions which might otherwise harden in and tend to clog said orifice means at said terminal end of said conduit means.

10. A container as set forth in claim 1 and further comprising adapter means for attachment to said dispenser tube means at a terminal end thereof for selectively defining an effective cross sectional area of said orifice means to regulate a rate of discharge of fluid from said reservoir upon compression forces applied to said walls of said container.

* * * * *